US005512068A

United States Patent [19]

Rollin et al.

[11] Patent Number: 5,512,068

[45] Date of Patent: Apr. 30, 1996

[54] REDUCING DEPOSIT FORMATION IN DIESEL ENGINES

[75] Inventors: Anthony J. Rollin, Midlothian; William J. Colucci, Glen Allen; Isaac L. Smith, Richmond, all of Va.

[73] Assignee: Ethyl Corporation, Richmond, Va.

[21] Appl. No.: 527,279

[22] Filed: Sep. 12, 1995

Related U.S. Application Data

[63] Continuation-in-part of Ser. No. 204,596, Mar. 2, 1994, Pat. No. 5,454,843.

[51] Int. Cl.[6] ..... C10L 1/12; C10L 1/18

[52] U.S. Cl. ..... 44/449; 44/447; 44/448

[58] Field of Search ..... 44/449, 448, 447

[56] References Cited

U.S. PATENT DOCUMENTS 2,922,822 1/1960 Beach ..... 44/447

4,497,721 2/1985 Katayama ..... 252/56 R 5,454,843 10/1995 Rollin et al. ..... 44/449

*Primary Examiner*—Ellen M. McAvoy

*Attorney, Agent, or Firm*—Dennis H. Rainear; William H. Thrower

[57] ABSTRACT

The invention relates to overcoming a new deposit problem, namely the formation on injector components and intake valves of diesel engines of deposits containing a substantial amount of inorganic material along with some organic binder materials. This problem has been traced to the presence of trace amounts of alkali metal salts in the fuel composition, and the invention overcomes the problem by including in such fuels a minor amount of at least one fuel-soluble complexing agent capable of forming in the diesel fuel oil a fuel-soluble complex with said inorganic alkali metal salt and/or the alkali metal cation thereof. The complexing agents used are selected from crown ethers, aza-crown ethers, polycrown ethers, lariat-crown ethers, cryptands, spherands, and bridged spherands.

20 Claims, No Drawings

REDUCING DEPOSIT FORMATION IN DIESEL ENGINES

This application is a continuation-in-part application of U.S. application Ser. No. 08/204,596 filed Mar. 2, 1994, now U.S. Pat. No. 5,454,843.

BACKGROUND OF THE INVENTION (1) Field of the Invention

This invention relates to and has as its principal object the provision of ways of overcoming a new type of deposit formation in gasoline and diesel engines by inclusion into the fuel composition a fuel-soluble complexing agent.

(2) Background Information

Original equipment manufactures of automotive vehicles have recently been experiencing a perplexing deposit problem, namely the formation of new types of deposits on injector system components of gasoline and diesel engines equipped with fuel injectors such as port fuel injectors, solenoid activated injectors, and the like. These deposits differ from the conventional type of deposits that tend to form both in carbureted fuel induction systems and in fuel injection systems of gasoline and diesel powered engines. The conventional deposits are gums or other organic residues that are believed to result primarily from the fuel itself or at least constituents thereof. Such deposits can be and have been effectively controlled by use of fuel additives that serve as detergents. A number of such additives are in widespread commercial use in present-day gasolines. Unfortunately, however, conventional detergent additives are ineffective in controlling these new types of deposits. These new types of deposits adhere tenaciously to fuel induction system components such as poppet valves of port fuel injectors, pintles of other types of fuel injection systems, intake valves, and the like. Such deposits can seriously interfere with proper engine operation.

These new types of deposits have been found to contain a substantial amount of inorganic material along with some organic binder materials. We have found for example that deposits formed on the intake valves of a 2.3 liter gasoline engine operated on an ordinary gasoline composition contained 5.1 wt % of sodium sulfate. Likewise we found that deposits that formed in a multiport fuel injector of a vehicle contained 2.1 wt % of sodium sulfate.

We have found that deposits formed on the fuel injectors of a diesel engine operated on an ordinary diesel fuel composition contained from 0.75 to 1.18 wt % of sodium sulfate. By Energy Dispersive X-ray Spectroscopy (lEDS), we have confirmed the presence of carbon, oxygen, zinc, magnesium, silicon, phosphorous, sulfur, calcium, chromium, iron, and the alkali metals sodium and potassium.

Without desiring to be bound by theoretical considerations, it is believed that these inorganic deposits result from the presence of trace quantities of inorganic salts in hydrocarbon fuels such as gasoline and diesel fuel which have been formed from hydrocarbon components (e.g., alkylates) prepared by processes in which acids or acidic materials such as sulfuric acid or hydrogen fluoride are neutralized with certain basic substances such as sodium hydroxide or potassium hydroxide. Such processing is believed to cause metal salts to be carried over into the finished fuel in trace amounts, perhaps in ionic form in trace amounts of water in the fuel. While in the past such salts may have been present in hydrocarbon fuels, their presence apparently caused no known problems. However their presence in fuels used in modem production and prototype engines equipped with fuel injection systems of modem design appears to have caused this new deposit problem. But whatever its precise cause, the new deposit problem can be traced to the presence in the fuel of trace amounts of alkali metal-containing impurities such as one or more alkali metal salts. Typically, the amounts of such impurities correspond to up to about 10 micrograms of alkali metal per milliliter of the fuel.

SUMMARY OF THE INVENTION

The invention relates to overcoming a new deposit problem, namely the formation on injector components and intake valves of diesel engines of deposits containing a substantial amount of inorganic material along with some organic binder materials. This problem has been traced to the presence of trace amounts of alkali metal salts in the fuel composition, and the invention overcomes the problem by including in such fuels a minor amount of at least one fuel-soluble complexing agent capable of forming in the diesel fuel oil a fuel-soluble complex with said inorganic alkali metal salt and/or the alkali metal cation thereof. The complexing agents used are selected from crown ethers, aza-crown ethers, polycrown ethers, lariat-crown ethers, cryptands, spherands, and bridged spherands.

DESCRIPTION OF THE PREFERRED EMBODIMENT

In accordance with this invention the foregoing new deposit problem is overcome by providing fuel compositions which comprise a gasoline fuel and a minor amount of at least one gasoline-soluble complexing agent capable of forming in the gasoline a gasoline-soluble complex with an inorganic alkali metal salt and/or the alkali metal cation thereof. The gasoline-soluble complexing agents used pursuant to this invention fall in the categories of (i) crown ethers, (ii) aza-crown ethers, (iii) polycrown ethers, (iv) lariat-crown ethers, (v) cryptands, (vi) spherands, and (vii) bridged spherands. These materials have the property of high specificity for complexation with alkali metals and their inorganic salts in non-polar media. Thus when the complexing agent is added to base fuels containing trace amounts of one or more inorganic alkali metal salts, the binding constant of the complexing agent is sufficiently high as to shift the complexation equilibrium far toward complete complexation so that, for example at least 75%, preferably at least 85%, and most preferably at least 95% of the alkali metal content of the fuel composition is tied up in the form of the gasoline-soluble metal complex. This is also applicable to fuel oils used for diesel engines.

By fuel oils used for diesel engines, or diesel fuel oils, we refer to middle distillate fuel oils that boil in the range of about 120° C. to 450° C. The fuel oil can comprise straight run, or cracked gas oil, or a blend in any proportion of straight run and thermally and/or catalytically cracked distillates. The most common petroleum distillate fuels are kerosene, diesel fuels, jet fuels and heating oils. The problem with deposits discussed above is most usually encountered with diesel fuels.

Crown ethers, aza-crown ethers, polycrown ethers, lariat-crown ethers, cryptands, spherands, and bridged spherands are known compounds. A wide variety of such complexing agents and their methods for their synthesis are reported in the literature. See for example R. M. Izatt, K. Pawlak, J. S. Bradshaw and R. L. Bruening, *Chem. Rev.* 1991, 1721–2085, and all references cited therein, all of which are incorporated herein by reference. Suitable complexing agents for use in the practice of this invention include 18-crown- 6,dibenzo-18-crown-6,4,13-diaza-18-crown-6,N,N'-dibenzyl-4,13-diaza-18-crown-6,N,N'-dipropyl-4,13-diaza-18-crown-6,N,N'-bis(2-hydroxyethyl)-4,13-diaza-18-crown-6, N,N'-bis(2-methoxyethyl)-4,13-diaza-18-crown-6, N,N'-dibenzyl-4,10-diaza-15-crown-5, N,N'-bis(2-methoxyethyl)-4,10-diaza-15-crown-5, spher-24C-1, bridged spher-8, bridged spher-12, bridged spher-15, and similar compounds. The nomenclature for such complexing agents is in accordance with that utilized by R. M. Izatt, K. Pawlak, J. S. Bradshaw and R. L. Bruening, loc. cit.

In another of its embodiments, this invention provides a method of reducing formation of fuel injection system deposits containing inorganic alkali metal salt which comprises supplying as the fuel to said injection system a fuel composition comprised of a diesel fuel containing a trace amount of alkali metal salt and a minor amount of at least one fuel-soluble complexing agent capable of forming in the diesel fuel a fuel-soluble complex with said inorganic alkali metal salt and/or the alkali metal cation thereof.

A further embodiment of this invention relates to improvements in the production of a diesel fuel composition. In accordance with this embodiment, in the process of formulating a diesel fuel comprising at least one fuel component containing an alkali metal-containing impurity in an amount such that the alkali metal content of the finished fuel composition is from about 0.01 to about 10 micrograms per milliliter, the improvement comprises the step of blending into the diesel fuel composition a minor complexing amount of at least one fuel-soluble complexing agent capable of forming in the diesel fuel a fuel-soluble complex with inorganic alkali metal salt and/or the alkali metal cation thereof.

Yet another embodiment is a fuel composition which comprises diesel fuel containing at least one fuel-soluble complexing agent in an amount of up to 200 pounds per thousand barrels, and wherein said complexing agent is selected from the group consisting of crown ethers, aza-crown ethers, polycrown ethers, lariat-crown ethers, cryptands, spherands, and bridged spherands and wherein said complexing agent is capable of forming in the diesel fuel a fuel-soluble complex with an inorganic alkali metal salt and/or the alkali metal cation thereof.

In addition to having the ability to form in diesel fuel a fuel soluble complex with an inorganic metal salt and/or the alkali metal cation thereof, the complexing agents used in the practice of this invention can also be and in most cases are capable of forming in diesel fuel complexes with other metals or metal salts as well. Indeed, this is an advantageous feature of this invention. It will be understood, however, that it is essential that the complexing agent be capable of at least complexing alkali metals and/or the salts thereof in diesel fuel.

The above and other embodiments and features of this invention will become still further apparent from the ensuing description and appended claims.

As noted above, an advantageous feature of this invention is that besides complexing the alkali metals or their salts, the complexing agents used for the most part also have the ability to complex other metallic impurities that may be present in the fuel, such as alkaline earth metals and their salts, and a number of the heavier metals and their salts as well.

The crown ethers, aza-crown ethers, polycrown ethers, lariat-crown ethers, cryptands, spherands, and bridged spherands used in the practice of this invention differ sharply from chelating agents of the type used heretofore as metal deactivators in gasolines in order to form complexes with metallic impurities such as copper. Those chelating agents have little if any ability to form complexes with alkali metals or their salts.

The amount of the complexing agent used in the fuel composition will generally be dependent upon the amount of alkali metal contained in the fuel, and the extent of complexation desired. For most diesel fuels amounts of the complexing agent of up to 200 pounds per thousand barrels of fuel will suffice. Another way of expressing concentration involves the relationship between the alkali metal content of the fuel and the log of the binding constant of the complexing agent being used. For alkali metal contents in the fuel less than 10 micrograms per milliliter, the log of the binding constant of the complexing agent used should be greater than 4 and preferably greater than 5. Normally, the log of the binding constant need not exceed 20, and typically will be below 15.

In most cases, the alkali metal impurity-containing fuels treated pursuant to this invention will contain in the range of about 0.01 to about 10 micrograms of alkali metal per milliter of fuel. Typically therefore the amount of the complexing agent will fall in the range of about 0.1 to about 200 pounds per thousand barrels. Adjustments can be made in these proportions whenever deemed necessary or appropriate in relation to the situation at hand.

Other components which may be used include the following:

Detergents. Any of a number of different types of suitable diesel fuel oil detergent additives can be included in the diesel fuel compositions of this invention. These detergents include succinimide detergent/dispersants, long-chain aliphatic polyamines, long-chain Mannich bases, and carbamate detergents.

Antioxidants. Various compounds known for use as oxidation inhibitors can be utilized in the practice of this invention. These include phenolic antioxidants, amine antioxidants, sulfurized phenolic compounds, and organic phosphites, among others.

Demulsifiers. A wide variety of demulsifiers are available for use in the practice of this invention, including, for example, organic sulfonates, polyoxyalkylene glycols, oxyalkylated phenolic resins, and like materials. Mixtures of alkylaryl sulfonates, polyoxyalkylene glycols and oxyalkylated alkylphenolic resins, such as are available commercially from Petrolite Corporation under the TOLAD trademark are suitable for use in the invention. Other known demulsifiers can be used.

Corrosion Inhibitors. Here again, a variety of materials are available for use in the practice of this invention. Thus, use can be made of dimer and trimer acids, such as are produced from tall oil fatty acids, oleic acid, linoleic acid, or the like. Another useful type of corrosion inhibitor for use in the practice of this invention are the alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols, and amino-succinic acids and derivatives thereof.

Metal Deactivators. If desired, the fuel compositions of this invention may contain a conventional type of metal deactivator of the type having the ability to form complexes with heavy metals such as copper and the like. Typically, the metal deactivators used are fuel soluble N,N'-disalicylidene-1,2-alkanediamines or N,N'-disalicylidene- 1,2-cycloalkanediamines, or mixtures thereof. Examples include N,N'-disalicylidene- 1,2-ethanediamine, N,N'-disalicylidene-1,2-propanediamine, N,N'-disalicylidene- 1,2-cyclohexanediamine, and N,N"-disalicylidene-N'-methyldipropylenetriamine.

The various additives that can be included in the diesel fuel compositions of this invention are used in conventional amounts. Thus, the amounts of such optional additives are not critical to the practice of this invention. The amounts used in any particular case are sufficient to provide the desired functional property to the fuel composition, and such amounts are well known to those skilled in the art.

The practice of this invention is illustrated by the examples set forth in Table I.

In these tabulated examples, the complexing agents ("Agent") used are as follows:

| | |
|---|---|
| A | 18-Crown-6 (18C6-1) with a molecular weight of 264; |
| B | Dibenzo-18-crown-6 ($B_2$18C6-1) with a molecular weight of 368; |
| C | 15-Crown-5 (15C5-1) with a molecular weight of 220; |
| D | [2.2.2]-Cryptand ([2.2.2]-1) with a molecular weight of 376; |
| E | 4,13-Diaza-18-crown-6 ($A_2$-18C-1) with a molecular weight of 262; |
| F | N,N'-Bis(methoxyethyl)-4,13-diaza-18-crown-6 ($A_2$18C6-14) BiBEL with a molecular weight of 378; |
| G | Benzo-18-crown-6 acrylamide polymer (poly(B18C6)-1) with a molecular weight of 382 for the monomer (See K. Kimura, T. Maeda, T. Shono, Talanta 1979, 26, 945–949); |
| H | Spher-24C-3 with a molecular weight of 920; |
| I | Bridged Spher-17 with a molecular weight of 694; and |
| J | $K_2$Phen18C6-1 with a molecular weight of 382. |

The code designations enclosed in parentheses for each complexing agent listed above follow the coding system used by R. M. Izatt, K. Pawlak, J. S. Bradshaw and R. L. Bruening, *Chem. Rev.* 1991, 1721–2085. The concentrations of the specified metal ions in the fuel (i.e., $Na^+$, $K^+$ and $Ca^{++}$ are given in terms of micrograms per mL. The treat rates are given in terms of pounds per thousand barrels (ptb) and represent the amount theoretically required to bind 95% of the amount of metal ($Na^+$, $K^+$ and $Ca^{++}$) specified. The footnotes to Table I specify the basis for each of the values of Log K shown. It will be understood that these examples are not intended to limit, do not limit, and should not be construed as limiting the practice of this invention in its genetic aspects.

TABLE I

| Example | Agent | Log K | $Na^+$ | $K^+$ | $Ca^{++}$ | Treat Rate, ptb |
|---|---|---|---|---|---|---|
| 1 | A | 6.11[a] | 0.1 | | | 1.75 |
| 2 | A | 6.11[a] | 0.5 | | | 3.28 |
| 3 | A | 6.11[a] | 1.0 | | | 5.19 |
| 4 | A | 11[a] | | 0.1 | | 0.22 |
| 5 | A | 11[a] | | 0.5 | | 1.12 |
| 6 | A | 11[a] | | 1.0 | | 2.25 |
| 7 | A | 5.09[b] | | | 0.1 | 14.51 |
| 8 | A | 5.09[b] | | | 0.5 | 15.39 |
| 9 | A | 5.90[b] | | | 1.0 | 16.48 |
| 10 | B | 5.11[a] | 0.1 | | | 19.56 |
| 11 | B | 5.11[a] | 0.5 | | | 21.69 |
| 12 | B | 5.11[a] | 1.0 | | | 24.35 |
| 13 | B | 7.55[a] | | 0.1 | | 0.38 |
| 14 | B | 7.55[a] | | 0.5 | | 1.64 |
| 15 | B | 7.55[a] | | 1.0 | | 3.20 |

TABLE I-continued

| Example | Agent | Log K | $Na^+$ | $K^+$ | $Ca^{++}$ | Treat Rate, ptb |
|---|---|---|---|---|---|---|
| 16 | C | 5.38[c] | 0.1 | | | 6.43 |
| 17 | C | 5.38[c] | 0.5 | | | 7.70 |
| 18 | C | 5.38[c] | 1.0 | | | 9.29 |
| 19 | C | 5.90[b] | | 0.1 | | 2.03 |
| 20 | C | 5.90[b] | | 0.5 | | 2.78 |
| 21 | C | 5.90[b] | | 1.0 | | 3.72 |
| 22 | D | 10.6[d] | 0.1 | | | 0.54 |
| 23 | D | 10.6[d] | 0.5 | | | 2.72 |
| 24 | D | 10.6[d] | 1.0 | | | 5.45 |
| 25 | D | 13.0[d] | | 0.1 | | 0.32 |
| 26 | D | 13.0[d] | | 0.5 | | 1.60 |
| 27 | D | 13.0[d] | | 1.0 | | 3.20 |
| 28 | E | 4.49[c] | 0.1 | | | 56.84 |
| 29 | E | 4.49[c] | 0.5 | | | 58.36 |
| 30 | E | 4.49[c] | 1.0 | | | 60.26 |
| 31 | E | 4.13[c] | | 0.1 | | 130.0 |
| 32 | E | 4.13[c] | | 0.5 | | 130.0 |
| 33 | E | 4.13[c] | | 1.0 | | 132.0 |
| 34 | F | 4.77[c] | 0.1 | | | 43.30 |
| 35 | F | 4.77[c] | 0.5 | | | 45.49 |
| 36 | F | 4.77[c] | 1.0 | | | 48.22 |
| 37 | F | 5.52[c] | | 0.1 | | 7.92 |
| 39 | F | 5.52[c] | | 0.5 | | 9.21 |
| 39 | F | 5.52[c] | | 1.0 | | 10.82 |
| 40 | F | 4.48[c] | | | 0.1 | 83.67 |
| 41 | F | 4.48[c] | | | 0.5 | 84.93 |
| 42 | F | 4.48[c] | | | 1.0 | 86.50 |
| 43 | G | 6.53[a] | 0.1 | | | 1.30 |
| 44 | G | 6.53[a] | 0.5 | | | 3.52 |
| 45 | G | 6.53[a] | 1.0 | | | 6.28 |
| 46 | G | 8.39[a] | | 0.1 | | 0.34 |
| 47 | G | 8.39[a] | | 0.5 | | 1.64 |
| 48 | G | 8.39[a] | | 1.0 | | 3.26 |
| 49 | H | 9.96[a] | 0.1 | | | 1.33 |
| 50 | H | 9.96[a] | 0.5 | | | 6.66 |
| 51 | H | 9.96[a] | 1.0 | | | 13.33 |
| 52 | H | 10.40[a] | | 0.1 | | 0.78 |
| 53 | H | 10.40[a] | | 0.5 | | 3.92 |
| 54 | H | 10.40[a] | | 1.0 | | 7.84 |
| 55 | I | 11.72[a] | 0.1 | | | 1.00 |
| 56 | I | 11.72[a] | 0.5 | | | 5.03 |
| 57 | I | 11.72[a] | 1.0 | | | 10.05 |
| 58 | I | 12.00[a] | | 0.1 | | 0.59 |
| 59 | I | 12.00[a] | | 0.5 | | 2.96 |
| 60 | I | 12.00[a] | | 1.0 | | 5.91 |
| 61 | J | 6.45[a] | 0.1 | | | 1.46 |
| 62 | J | 6.45[a] | 0.5 | | | 3.67 |
| 63 | J | 6.45[a] | 1.0 | | | 6.44 |
| 64 | J | 7.49[a] | | 0.1 | | 0.41 |
| 65 | J | 7.49[a] | | 0.5 | | 1.71 |
| 66 | J | 7.49[a] | | 1.0 | | 3.34 |
| 67 | J | 7.59[a] | | | 0.1 | 0.38 |
| 68 | J | 7.59[a] | | | 0.5 | 1.65 |
| 69 | J | 7.59[a] | | | 1.0 | 3.24 |

a - In $CDCl_3$
b - In EtOH
c - In MeCN
d - In $CH_2Cl_2$
e - In MeOH

The term "fuel soluble" means that the additive material in question can be dissolved in the diesel fuel being treated to at least the concentration necessary for the material to perform its desired function. Preferably, the additive will have a solubility in excess of this minimum value. However, the term "fuel soluble" does not mean that the material must be soluble in all proportions in the diesel fuel composition.

This invention is susceptible to considerable variation in its practice. Accordingly, this invention is not limited to the specific exemplifications set forth hereinabove. Rather, this invention is within the spirit and scope of the appended claims, including the equivalents thereof available as a matter of law.

We claim:

1. A fuel composition which comprises a diesel fuel oil containing a trace amount of alkali metal salt and a minor amount of at least one fuel-soluble complexing agent capable of forming in the fuel a fuel-soluble complex with said inorganic alkali metal salt and/or the alkali metal cation thereof, said complexing agent being selected from the group consisting of crown ethers, aza-crown ethers, polycrown ethers, lariat-crown ethers, cryptands, spherands and bridged spherands.

2. A composition in accordance with claim 1 wherein the binding constant provided by the complexing agent is sufficiently high so that at least 85% of the alkali metal content of the fuel composition is tied up in the form of the fuel-soluble complex.

3. A composition in accordance with claim 1 wherein the binding constant provided by the complexing agent is sufficiently high so that at least 95% of the alkali metal content of the fuel composition is tied up in the form of the fuel-soluble complex.

4. A composition in accordance with claim 1 wherein the complexing agent is at least one crown ether.

5. A composition in accordance with claim 1 wherein the complexing agent is at least one aza-crown ether.

6. A composition in accordance with claim 1 wherein the complexing agent is at least one polycrown ether.

7. A composition in accordance with claim 1 wherein the complexing agent is at least one lariat-crown ether.

8. A composition in accordance with claim 1 wherein the complexing agent is at least one cryptand.

9. A composition in accordance with claim 1 wherein the complexing agent is at least one spherand.

10. A composition in accordance with claim 1 wherein the complexing agent is at least one bridged spherand.

11. A method of reducing formation of fuel injection system deposits containing inorganic alkali metal salt which comprises supplying as the fuel to said injection system a fuel composition comprised of a diesel fuel oil containing a trace amount of alkali metal salt and a minor amount of at least one fuel-soluble complexing agent capable of forming in the diesel fuel oil a fuel-soluble complex with said inorganic alkali metal salt and/or the alkali metal cation thereof, said complexing agent being selected from the group consisting of crown ethers, aza-crown ethers, polycrown ethers, lariat-crown ethers, cryptands, spherands and bridged spherands.

12. In a method for the production of a diesel fuel oil composition comprising at least one fuel component containing an alkali metal-containing impurity in an amount such that the alkali metal content of the finished fuel composition is from about 0.01 to about 10 micrograms per milliliter, the step of blending into the diesel fuel oil composition a minor complexing amount of at least one fuel-soluble complexing agent capable of forming in the diesel fuel oil a fuel-soluble complex with inorganic alkali metal salt and/or the alkali metal cation thereof, said complexing agent being selected from the group consisting of crown ethers, aza-crown ethers, polycrown ethers, lariat-crown ethers, cryptands, spherands and bridged spherands.

13. A fuel composition which comprises diesel fuel oil containing at least one fuel-soluble complexing agent in an amount of up to 200 pounds per thousand barrels, and wherein said complexing agent is selected from the group consisting of crown ethers, aza-crown ethers, polycrown ethers, lariat-crown ethers, cryptands, spherands, and bridged spherands and wherein said complexing agent is capable of forming in the diesel fuel oil a fuel-soluble complex with an inorganic alkali metal salt and/or the alkali metal cation thereof.

14. A fuel composition in accordance with claim 13 wherein the complexing agent is 18-crown-6.

15. A fuel composition in accordance with claim 13 wherein the complexing agent is [2.2.2]-cryptand.

16. A fuel composition in accordance with claim 13 wherein the complexing agent is benzo-18-crown-6 acrylamide polymer.

17. A fuel composition in accordance with claim 13 wherein the complexing agent is N,N'-bis(methoxyethyl)-4,13-diaza-18-crown-6.

18. A fuel composition in accordance with claim 13 wherein the complexing agent is spher-24C-3.

19. A fuel composition in accordance with claim 13 wherein the complexing agent is bridged spher-17.

20. A fuel composition in accordance with claim 13 wherein the complexing agent is K2phen18C6-1.

* * * * *